US006673168B1

(12) United States Patent
Matucha et al.

(10) Patent No.: US 6,673,168 B1
(45) Date of Patent: Jan. 6, 2004

(54) MATERIAL ON AN ALUMINUM BASIS FOR ANTI-FRICTION BEARINGS

(75) Inventors: Karl-Heinz Matucha, Kelkheim (DE); Thomas Steffens, Bad Rappenau (DE); Werner Schubert, Wiesloch (DE)

(73) Assignee: KS Gleitlager GmbH, St. Leon-Rot (DE)

( * ) Notice: Subject to any disclaimer, the term of this patent is extended or adjusted under 35 U.S.C. 154(b) by 0 days.

(21) Appl. No.: 09/700,887

(22) PCT Filed: Jul. 20, 1999

(86) PCT No.: PCT/EP99/05152

§ 371 (c)(1),
(2), (4) Date: Nov. 20, 2000

(87) PCT Pub. No.: WO00/05427

PCT Pub. Date: Feb. 3, 2000

(30) Foreign Application Priority Data

Jul. 23, 1998 (DE) ..... 198 33 200

(51) Int. Cl.[7] ..... C22C 21/00
(52) U.S. Cl. ..... 148/437; 420/548; 420/550
(58) Field of Search ..... 420/550, 554, 420/548; 148/415, 437

(56) References Cited

U.S. PATENT DOCUMENTS 4,471,032 A 9/1984 Fukuoka et al. ..... 428/653
4,789,607 A * 12/1988 Fujita et al. ..... 428/653
5,104,444 A * 4/1992 Shioda et al. ..... 75/249

FOREIGN PATENT DOCUMENTS

| | | | |
|---|---|---|---|
| DE | 69936 | | 4/1892 |
| DE | 29 28 004 | | 1/1980 |
| GB | 623486 | | 5/1949 |
| JP | 57-188641 A | * | 11/1982 |
| JP | 57 164952 | | 1/1983 |
| JP | 04-009443 A | * | 1/1992 |

OTHER PUBLICATIONS

226139, Jan. 1998, Chemial Abstracts.

* cited by examiner

*Primary Examiner*—George Wyszomierski
*Assistant Examiner*—Janelle Combs Morillo
(74) *Attorney, Agent, or Firm*—Young & Basile, PC

(57) ABSTRACT

An aluminum-based material for anti-friction bearings composed of an aluminum alloy with 10–25 wt % tin or 5–25 wt % lead, impurity-caused components characterized by 0.75–2.5 wt % iron and an alloy additive capable of forming an intermetallic compound having a spherical phase homogeneously distributed in the aluminum alloy. The alloy additive is one of:

a) manganese and silicon, in which the weight percentage fractions of manganese and silicon are at least half the weight percentage fraction of the iron and for manganese, at most 3 wt %, and for silicon, at most 2 wt %;

b) 0.1–0.5 wt % cobalt; and c) 0.1–0.5 wt % molybdenum.

6 Claims, No Drawings

MATERIAL ON AN ALUMINUM BASIS FOR ANTI-FRICTION BEARINGS

BACKGROUND

The invention concerns a material on an aluminum basis for anti-friction bearings, comprising an aluminum alloy with 10–25 wt % tin or 5–25 wt % lead and impurity-caused components.

The aluminum alloy, known under the abbreviated designation of AlSn20, usually contains impurities of iron, which are usually indicated as less than 0.7% by the manufacturer. In fact, the impurity-caused iron content, however, usually is in the range of 0.3–0.4 wt %. According to current assessments, iron in aluminum alloys is anything but desired, since intermetallic phases, such as $Al_3Fe$ or in the presence of silicon, $FeSiAl_5$, which are formed, have an embrittlement effect and thus reduce resistance to fatigue and have a negative effect with regard to shaping capacity. Iron aluminide crystallizes, namely, producing beam-like and needle shapes, or forms thin plates, which form potential breakage nuclei and hinder shaping. The effort, therefore, is to keep the iron content of the aluminum alloy forming anti-friction bearings as low as possible, which limits the use of secondary aluminum or circulating scrap for the production of the anti-friction bearing material and raises production costs.

Typical materials on an aluminum basis for anti-friction bearings are also known from DE-A 69936 and from U.S. Pat. No. 4,471,032. From these publications, alloy additives are known to a large extent; the problem mentioned in the preceding, however, is not addressed. Proceeding from here, the goal of the invention under consideration is to improve a material for anti-friction bearings of the type described above, to the effect that it exhibits, on the one hand, a good shaping behavior and has a high resistance to fatigue, and furthermore, contains additives which form hard phases, but which do not exhibit an embrittlement effect, wherein the material for the anti-friction bearings can be produced at a low cost.

DETAILED DESCRIPTION OF THE INVENTION

This goal is attained by a material for anti-friction bearings of the type mentioned, which is characterized by 0.75–2.5 wt % iron and alloy additives in the form of:

a) manganese and silicon, wherein the weight percentage fractions of manganese and silicon are at least half the weight percentage fraction of the iron and for manganese, at most 3 wt % and for silicon, at most 2 wt %; or b) 0.1–0.5 wt % cobalt or molybdenum.

It has been determined that the disadvantageous morphology of the iron aluminides, described above, can be improved by the purposeful addition of either manganese and silicon or cobalt or molybdenum. Intermetallic compounds of iron, manganese, aluminum, and silicon or iron cobalt-mixed aluminides or iron molybdenum-mixed aluminides are formed, whose morphology is suitable for the production of a material for anti-friction bearings with respect to a good shaping capacity and a high resistance to fatigue, since it cannot be designated as needle- or plate-shaped, but rather is characterized by spherical, homogeneously distributed phases, so that one can speak of a globular separation. For example, with the addition of manganese and silicon, one can mention eutectic [(FeMn)$_3Si_2Al_{15}$] and with higher contents, primary (FeMn)$_3Si_2Al_{15}$. With the addition of cobalt or molybdenum, globular separations of the $(CoFe)_3A_{19}$ or $MoFeAl_X$ types are formed.

According to the invention, the iron separations are modified in such a way that they can absolutely be used to increase hardness. With the invention, it is therefore proposed that the iron content present, in any case, in secondary aluminum not be reduced in an expensive manner, but rather that the iron contained therein be used consciously in the manner described in the preceding in that the iron content is increased to the range indicated and the quantities of either manganese and silicon or cobalt or molybdenum, indicated in the preceding, be added. The lower limit of the manganese and silicon content is in the ratio to the iron content, mentioned in the preceding, so as to, sufficiently or to a large extent, prevent the formation of undesired iron aluminides. With respect to the improvement of the morphology of iron separations, the addition of manganese and silicon or, alternately, cobalt or molybdenum was recognized as being equivalent, in principle.

Therefore, for the first time, the conscious use of iron-containing aluminum-tin or aluminum-lead alloys is proposed, by the invention, for the production of materials for anti-friction bearings.

Aluminum/tin/iron alloys also have the advantage that iron is practically insoluble in the aluminum matrix, and thus the corresponding iron-containing separation phases are annealing-stable and, in a thermal treatment, do not coarsen. Such alloys have the additional advantage that secondary aluminum containing circulation scrap can be used for the production of the materials for anti-friction bearings. The material costs are therefore lower, since there is no requirement of low-iron qualities with the metals to be purchased. A part of the iron, for example, in the range of 0.3–0.4%, is also contained in the secondary aluminum more or less free of charge.

The following alloys have proved to be particularly advantageous.

AlSn12Fe1Mn0, 5Si0,5,

AlSn12Fe1Co0, 2,

AlSn12Fe1Mo0, 2,

A combination of these alloys can also be used.

What is claimed is:

1. An aluminum-based material for anti-friction bearings, the material consisting essentially of:

an aluminum alloy with 10–25 wt % tin;

impurity-caused components, the impurity-caused components characterized by 0.8–1.2 wt % iron and;

an alloy additive capable of forming an intermetallic compound having a spherical phase homogeneously distributed in the aluminum alloy, the alloy additive selected from the group consisting of:

a) manganese and silicon, wherein the individual weight percentage fractions of manganese and silicon are at least half the weight percentage fraction of the iron and for manganese, 0.4–0.6 wt %, and for silicon, 0.4–0.6 wt %;

b) 0.1–0.5 wt % cobalt; and c) 0.1–0.5 wt % molybdenum;

wherein the intermetallic compound formed by the alloy additive is at least one of iron-manganese-aluminum-silicon complexes, iron-cobalt mixed aluminides and iron molybdenum-mixed aluminides.

2. Material for anti-friction bearings according to claim 1, characterized by 0.1–0.3 wt % cobalt.

3. Material for anti-friction bearings according to claim 1, characterized by 0.1–0.3 wt % molybdenum.

4. Material for anti-friction bearings according to claim 1, characterized by 10–14 wt % tin.

5. An aluminum-based material for anti-friction bearings, consisting of:

an aluminum alloy with 10–25 wt % tin;

impurity-caused components, the impurity-caused components characterized by 0.75–2.5 wt % iron; and an alloy additive of manganese and silicon, wherein the individual weight percentage fractions of manganese and silicon are at least half the weight percentage fraction of the iron and for manganese, at most 3 wt %, and for silicon, at most 2 wt %, the alloy additive capable of forming an intermetallic compound having a spherical phase homogeneously distributed in the aluminum alloy, wherein the intermetallic compound is of an iron-manganese-aluminum-silicon complex.

6. Material for anti-friction bearings according to claim 5, characterized in that iron has a weight percentage fraction of 0.8–1.5 wt %.

* * * * *